US009835051B2

(12) United States Patent
Sumi

(10) Patent No.: US 9,835,051 B2
(45) Date of Patent: Dec. 5, 2017

(54) WATER COOLED TURBINE HOUSING

(71) Applicant: Norihiko Sumi, Miyoshi (JP)

(72) Inventor: Norihiko Sumi, Miyoshi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 328 days.

(21) Appl. No.: 14/405,522

(22) PCT Filed: Sep. 10, 2013

(86) PCT No.: PCT/IB2013/001955
§ 371 (c)(1),
(2) Date: Dec. 4, 2014

(87) PCT Pub. No.: WO2014/041411
PCT Pub. Date: Mar. 20, 2014

(65) Prior Publication Data

US 2015/0167494 A1 Jun. 18, 2015

(30) Foreign Application Priority Data

Sep. 12, 2012 (JP) ..... 2012-200494

(51) Int. Cl.
*F01D 25/14* (2006.01)
*F01D 25/12* (2006.01)
*F02B 39/00* (2006.01)

(52) U.S. Cl.
CPC ..... *F01D 25/14* (2013.01); *F01D 25/12* (2013.01); *F02B 39/005* (2013.01); (Continued)

(58) Field of Classification Search
CPC ..... F01P 2060/12; F01P 11/04; F01D 25/14; F01D 25/28; F02B 39/005
See application file for complete search history.

(56) References Cited

U.S. PATENT DOCUMENTS 9,086,011 B2 * 7/2015 Roth ..... F02B 37/001
2006/0083609 A1 * 4/2006 Augspurger ..... F01D 25/002 415/206

(Continued)

FOREIGN PATENT DOCUMENTS

DE 102011003905 A1 8/2012
DE 102011003906 A1 8/2012

(Continued)

OTHER PUBLICATIONS

English Translation of JP1-17618U.*
Jul. 10, 2014 Partial Translation of Office Action issued in Japanese Application No. 2012-200494.

*Primary Examiner* — Woody Lee, Jr.
*Assistant Examiner* — Topaz L Elliott
(74) *Attorney, Agent, or Firm* — Oliff PLC

(57) ABSTRACT

A gas passage that is connected to an exhaust passage and a water passage that is connected to a water jacket are formed in a turbine housing. The water passage and the gas passage are arranged adjacent to each other in an exhaust gas-introducing side joint part of the turbine housing, and a mating face in which the water passage opens and a mating face in which the gas passage opens are formed not to connect smoothly to each other. The turbine housing is attached to the cylinder head with an O-ring that prevents leakage of coolant interposed between the mating face and the cylinder head, and a seal member that prevents leakage of exhaust gas interposed between the mating face and the cylinder head.

3 Claims, 4 Drawing Sheets

(52) U.S. Cl.
CPC ..... *F05D 2220/40* (2013.01); *F05D 2240/55* (2013.01); *F05D 2250/38* (2013.01); *F05D 2250/51* (2013.01)

(56) References Cited

U.S. PATENT DOCUMENTS

| | | | | |
|---|---|---|---|---|
| 2009/0151327 | A1 * | 6/2009 | Zimmermann | F02B 67/10 60/280 |
| 2011/0154818 | A1 | 6/2011 | Takahata | |
| 2013/0315712 | A1 | 11/2013 | Bogner et al. | |
| 2013/0323020 | A1 | 12/2013 | Bogner et al. | |
| 2013/0323022 | A1 | 12/2013 | Bogner et al. | |

FOREIGN PATENT DOCUMENTS

| | | | | |
|---|---|---|---|---|
| DE | 102011003907 | A1 | 8/2012 | |
| JP | S60159836 | U1 | 10/1985 | |
| JP | 1-17618 | U * | 5/1989 | F02B 39/00 |

* cited by examiner

WATER COOLED TURBINE HOUSING

BACKGROUND OF THE INVENTION

1. Field of the Invention

The present invention relates to a turbine housing in which a water passage through which engine coolant flows is formed.

2. Description of Related Art

A water-cooled turbocharger is proposed in US 2009/0151327 A. In the turbine housing for a turbocharger that is disclosed in US 2009/0151327 A, a gas passage through which exhaust gas flows and a water passage through which coolant flows both extend to open in the part that will be connected to an internal combustion engine (specifically, a connecting flange on the side from which exhaust gas is introduced). Thus, the gas passage is connected to the exhaust passage of the internal combustion engine and the water passage is connected to the water jacket of the internal combustion engine through an operation of attaching the turbine housing to the internal combustion engine. Therefore, the turbocharger can be attached easily compared to the case where the gas passage and the water passage should be connected to the internal combustion engine through separate operations.

SUMMARY OF THE INVENTION

A metal seal member that prevents leakage of exhaust gas from the gas passage and a rubber O-ring that prevents leakage of coolant from the water passage are provided at the connection between the turbine housing and the internal combustion engine (specifically, between their mating faces). In a turbocharger, there is a possibility that a tiny amount of exhaust gas leaks from the connection between the gas passage and the exhaust passage in spite of the presence of a seal member at the connection.

In the turbine housing that is disclosed in US 2009/0151327 A, the gas passage and the water passage open in the same face. Thus, the exhaust gas that leaks from the gas passage into the gap between the mating faces of the turbine housing and the internal combustion engine is blown onto the O-ring between the same mating faces. In this case, the high-temperature exhaust gas may cause thermal degradation of the O-ring, resulting in a deterioration of the sealing performance of the O-ring.

The present invention provides a turbine housing which has a structure that enables it to be attached easily and is less likely to cause deterioration of the sealing performance of the water passage.

The means for it and its advantages are described below. A turbine housing according an aspect of the present invention includes a water passage, a gas passage, a joint part, a first seal member and a second seal member. The water passage is provided in the turbine housing. The water passage is connected to a water jacket of an internal combustion engine. The gas passage is provided in the turbine housing. The gas passage is connected to an exhaust passage of the internal combustion engine. The joint part is provided at a gas-introducing side of the turbine housing. The joint part has a first mating face in which the water passage opens and a second mating face in which the gas passage opens. The water passage and the gas passage are arranged adjacent to each other in the joint part. The second mating face does not connect smoothly to the first mating face. The first seal member is interposed between the first mating face and the internal combustion engine to prevent coolant from leaking.

The second seal member is interposed between the second mating face and the internal combustion engine to prevent exhaust gas from leaking.

In the turbine housing, the water passage and the gas passage are arranged in a side-by-side manner in the exhaust gas-introducing side joint part, and the water passage and the gas passage both open at the joint part. Thus, the gas passage can be connected to the exhaust passage and the water passage can be connected to the water jacket through an operation of connecting the joint part to the internal combustion engine (specifically, the cylinder head or exhaust passage thereof). Thus, the turbine housing has a structure that enables it to be attached easily.

In addition the first mating face, in which the water passage opens, and the second mating face, in which the gas passage opens, are formed not to connect smoothly to each other. Thus, when exhaust gas leaks from the gas passage onto the second mating face, on which the second seal member is located, the flow of the leaking exhaust gas is disturbed by the part between the first mating face and the second mating face, in other words, the part that do not connect smoothly to the mating face and the second mating face. This is a structure in which the exhaust gas that leaks onto the second mating face is less likely to reach the first mating face compared to the case where the water passage and the gas passage open in the same face. Thus, the turbine housing has a structure in which deterioration of the sealing performance of the water passage that is caused by exposure of the O-ring, which is provided on the first mating face to prevent leakage of coolant from the water passage, is less likely to occur.

In the turbine housing, the first mating face, the second mating face, and a connection portion that connects the first mating face to the second mating face may form a shape that is bent at one or more portions between an opening of the water passage and an opening of the gas passage.

According to the above turbine housing, because the flow of exhaust gas that leaks from the gas passage onto the second mating face and travels toward the first mating face is less likely to reach the first mating face because it is blocked by the Z-shaped surface. Thus, the first seal member on the first mating face can be prevented from being exposed to high-temperature exhaust gas.

In the turbine housing, the bent shape may be a stepwise shape that one of the first mating face and the second mating face protrudes relative to the other of the first mating face and the second mating face.

In the turbine housing, the joint part may have a pipe that extends in a direction across the second mating face, the pipe may constitute a part of the water passage, and the first mating face may be an outer periphery of a distal end portion of the pipe.

According to turbine housing, the water passage can be connected to the water jacket through an operation of connecting the joint part of the turbine housing to the internal combustion engine with a distal end portion of the pipe inserted into the connecting port of the internal combustion engine. In this case, the first seal member is provided between the outer periphery of the distal end portion of the pipe and the inner periphery of the connecting port of the internal combustion engine to prevent leakage of coolant from the water passage.

In the turbine housing, because the pipe extends in a direction across the second mating face, exhaust gas that leaks from the gas passage onto the second mating face is blown onto the outer periphery of the pipe. Thus, the exhaust gas that leaks onto the second mating face is less likely to reach the first mating face, in other words, the outer periphery of the distal end portion of the pipe that is inserted into the internal combustion engine. Thus, the first seal member on the first mating face can be prevented from being exposed to high-temperature exhaust gas.

In the turbine housing, the second mating face may be planar, and the pipe may extend in a direction normal to the second mating face.

According to the above turbine housing, the exhaust gas that leaks from the gas passage onto the second mating face is blown onto the outer periphery of the pipe almost at a right angle. Thus, the flow of exhaust gas is less likely to be directed toward the first mating face and is therefore unlikely to reach the first mating face. Thus, the first seal member on the first mating face can be suitably prevented from being exposed to high-temperature exhaust gas.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
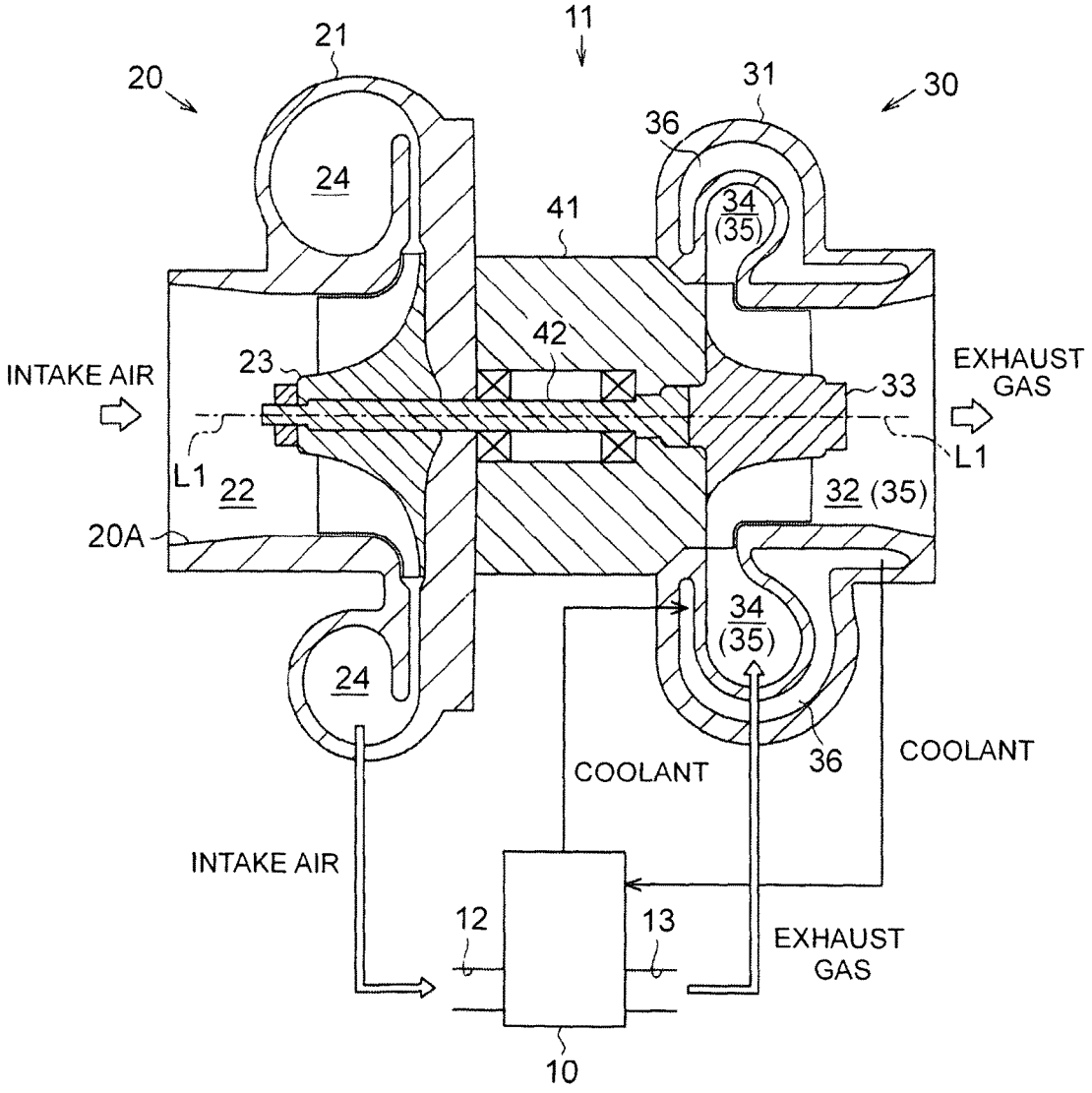
FIG. 1 is a cross-sectional view that schematically illustrates a cross-sectional structure of a turbocharger to which a turbine housing according to one embodiment which embodies the present invention is applied.

Description is hereinafter made of a turbine housing according to one embodiment that embodies the present invention. As shown in FIG. 1, a turbocharger 11 includes a compressor 20 that is installed in an intake passage 12 of an internal combustion engine 10, a turbine 30 that is installed in an exhaust passage 13 of the internal combustion engine 10, and a center housing 41 that couples the compressor 20 and the turbine 30.

A compressor housing 21 defines a compressor chamber 22, and a compressor wheel 23 is housed in the compressor chamber 22. A turbine housing 31 defines a turbine chamber 32, and a turbine wheel 33 is housed in the turbine chamber 32. A shaft 42 is rotatably supported by the center housing 41. The compressor wheel 23 is secured to one end of the shaft 42, and the turbine wheel 33 is secured to the other end of the shaft 42. The turbocharger 11 is constructed such that the compressor wheel 23 and the turbine wheel 33 rotate together.

The compressor chamber 22 extends along the rotation axis L1 of the compressor wheel 23. A scroll passage 24 that extends spirally around the compressor wheel 23 is formed in the compressor housing 21.

The turbine chamber 32 extends along the rotation axis L1 of the turbine wheel 33. A scroll passage 34 that extends spirally around the turbine wheel 33 is formed in the turbine housing 31. In this embodiment, the turbine chamber 32 and the scroll passage 34 function as a gas passage 35 through which exhaust gas flows.

The turbocharger 11 supercharges the internal combustion engine 10 as described below. When the exhaust gas from the internal combustion engine 10 is blown onto the turbine wheel 33 through the scroll passage 34, the turbine wheel 33 is rotated by the energy of the exhaust gas stream. Then, the rotation of the turbine wheel 33 is transmitted to the compressor wheel 23 via the shaft 42 and rotates the compressor wheel 23. Then, in the compressor 20, the intake air that flows into the compressor chamber 22 through an inlet 20A of the compressor 20 is fed to the scroll passage 24 then to each cylinder of the internal combustion engine 10 by the effect of the centrifugal force from the rotation of the compressor wheel 23. The internal combustion engine 10 uses the energy of exhaust gas to supercharge the intake air to improve the engine output.

Figure 2:
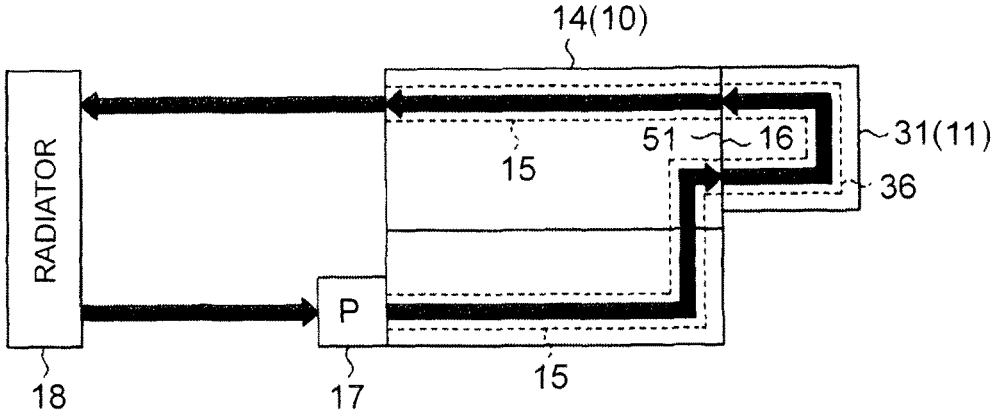
FIG. 2 is a schematic diagram that illustrates the manner in which coolant is circulated in an internal combustion engine and the turbine housing.

As shown in FIG. 1 or FIG. 2, a water-cooled turbocharger in which a water passage 36 which allows coolant flow through the turbine housing 31 is formed is adopted as the turbocharger 11. A portion of the coolant that is used to cool the internal combustion engine 10 is supplied to the water passage 36 when the internal combustion engine 10 is being operated.

The water passage 36 opens at a joint part 51 on the side from which exhaust gas is introduced into the scroll passage 34 (exhaust gas-introducing side) in the turbine housing 31. The joint part 51 is secured by bolts to a joint part 16 of a cylinder head 14 of the internal combustion engine 10 at which a water jacket 15 opens. Thus, the water passage 36 of the turbine housing 31 is communicated with the water jacket 15 of the internal combustion engine 10.

When the internal combustion engine 10 is started and a water pump 17 is driven, the coolant that is delivered under pressure by the water pump 17 is circulated through the coolant passage including the water jacket 15, the water passage 36 and a radiator 18 as indicated by arrows in FIG. 2. The internal combustion engine 10 and the turbocharger 11 are cooled by the circulation of the coolant.

A metal seal member that prevents leakage of exhaust gas from the gas passage 35 and a rubber O-ring that prevent leakage of coolant from the water passage 36 are provided between the joint part 51 of the turbine housing 31 and the joint part 16 of the cylinder head 14. In this embodiment, a tiny amount of exhaust gas may leak from the gas passage 35 into a gap between the mating faces of the joint parts 16 and 51 in spite of the presence of the seal member. When the leaking exhaust gas is blown onto the O-ring, the high-temperature exhaust gas may cause thermal degradation of the O-ring, resulting in a deterioration of the sealing performance of the O-ring.

In view of this point, a structure is employed in this embodiment which can reduce the possibility that the exhaust gas that leaks into the gap between the mating faces of the joint part 51 of the turbine housing 31 and the joint part 16 of the cylinder head 14 is blown onto the O-ring. The structure is described in detail below.

Figure 3:
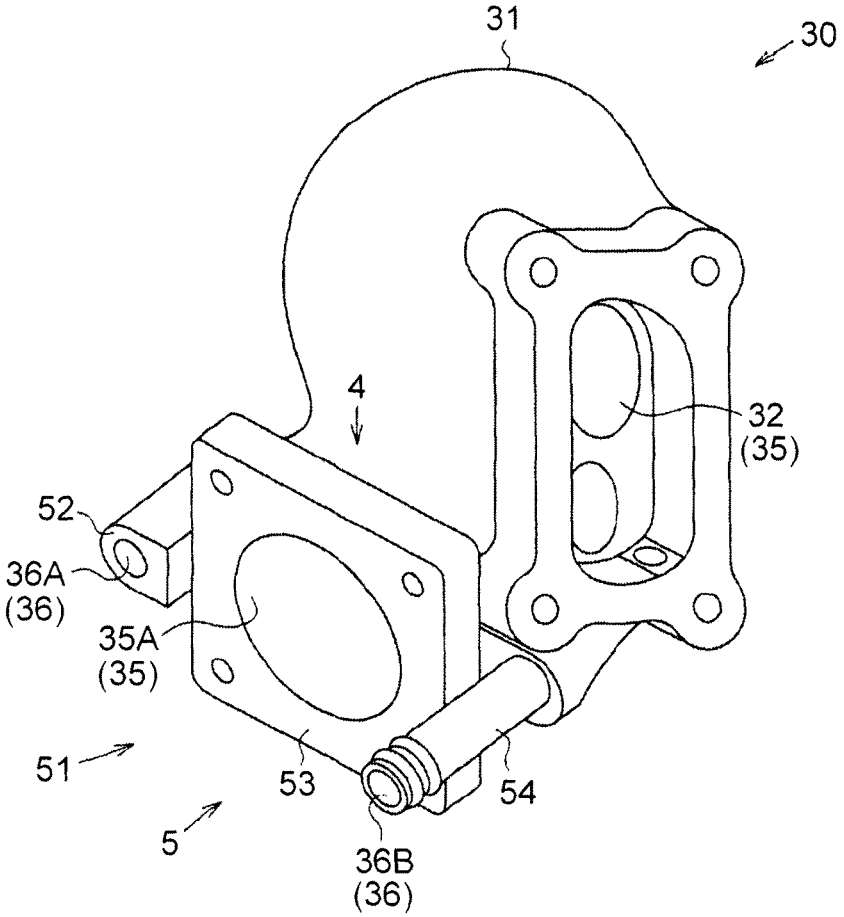
FIG. 3 is a perspective view that illustrates a perspective structure of the turbine housing.
Figure 4:
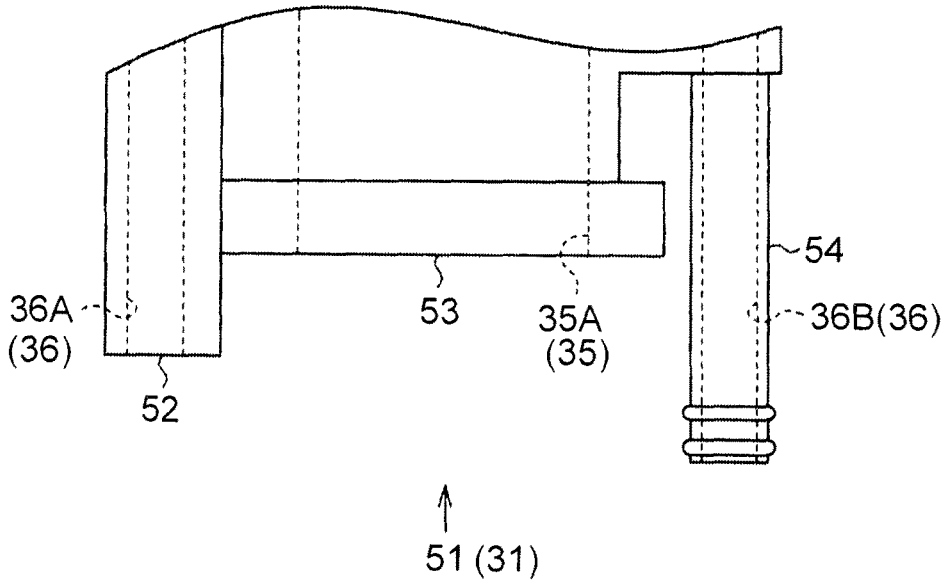
FIG. 4 is a side view that illustrates a side structure of a joint part of the turbine housing as seen in the direction of arrow 4 in FIG. 3.
Figure 5:
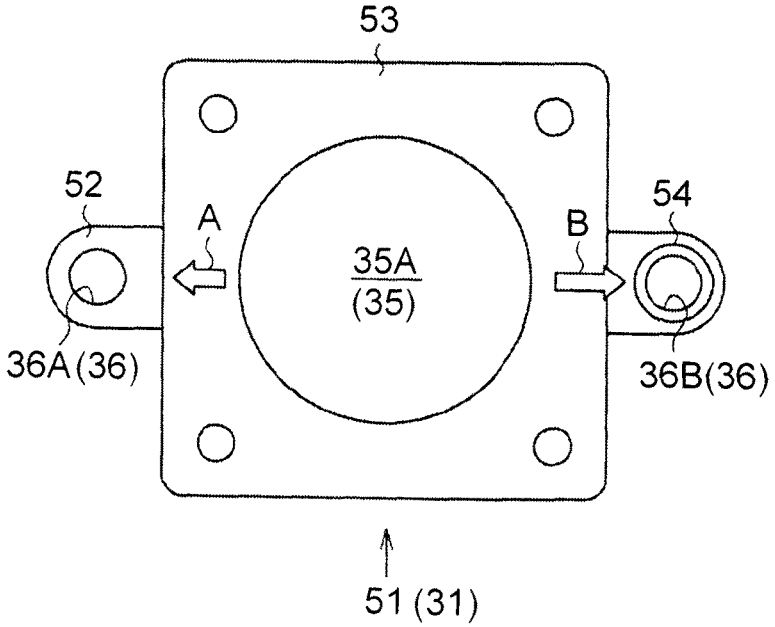
FIG. 5 is a side view that illustrates a side structure of the joint part of the turbine housing as seen in the direction of arrow 5 in FIG. 3.

As shown in FIG. 3 to FIG. 5, the water passage 36 and the gas passage 35, which are formed in the turbine housing 31, are arranged adjacent to each other (in a side-by-side manner) in the exhaust gas-introducing side joint part 51 of the turbine housing 31. Also, an exhaust gas-introducing side end 35A of the gas passage 35, a water introduction port 36A through which coolant is introduced into the water passage 36 and a water discharge port 36B through which coolant is discharged from the water passage 36 open at the joint part 51.

In addition, a mating face 52 in which the water introduction port 36A of the water passage 36 open and a mating face 53 in which the end 35A of the gas passage 35 open are both formed in a planar shape and do not connect smoothly to each other in the joint part 51. Specifically, the joint part 51 is formed in a stepwise configuration with the mating face 52 protruding relative to the mating face 53. Thus, because a face that extends in a direction across (in this embodiment, normal to) the mating faces 52 and 53 is formed between the mating faces 52 and 53, the mating faces 52 and 53 do not connect smoothly to each other. In other words, a part where the surface curvature changes more significantly than in the adjacent areas is formed between the mating faces 52 and 53.

In the joint part 51 of the turbine housing 31, a pipe 54 that forms a part of the water discharge port 36B of the water passage 36 is also located on the opposite side of the mating face 52 with respect to the mating face 53 and extends in a direction normal to the mating face 53. The pipe 54 protrudes in such a location that a gap is formed between its outer periphery and the mating face 53.

Figure 6:
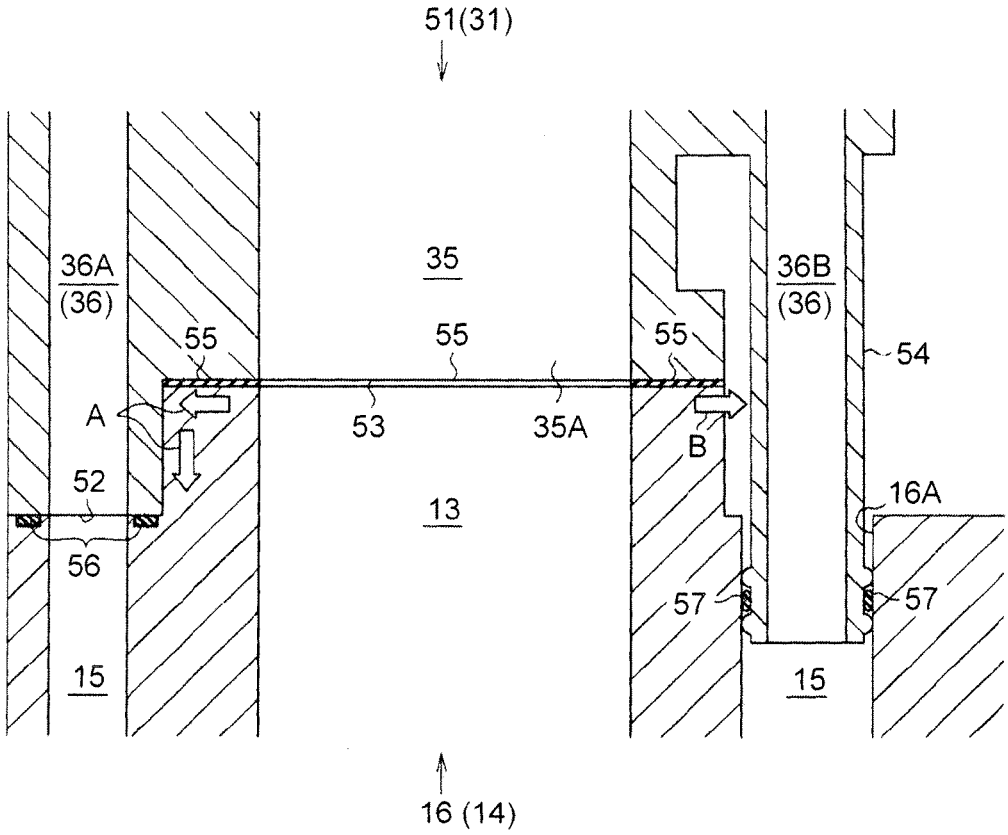
FIG. 6 is a cross-sectional view that illustrates the cross-sectional structure of joint parts and surrounding portions along a direction in which the gas passage and water passage extend.

The effect of forming the joint part 51 of the turbine housing 31 in the shape as described above is described below. FIG. 6 shows a cross-sectional view that illustrates the cross-sectional structure of the joint parts 16 and 51 and surrounding portions along a direction in which the gas passage 35 and the water passage 36 extend.

As shown in FIG. 4 to FIG. 6, the water introduction port 36A and the water discharge port 36B of the water passage 36 and the gas passage 35 are arranged side-by-side in the exhaust gas-introducing side joint part 51 of the turbine housing 31. In addition, the water introduction port 36A and the water discharge port 36B of the water passage 36 and the gas passage 35 open at the joint part 51. In addition, in the joint part 16 of the cylinder head 14, the water jacket 15 opens at a location corresponding to the opening of the water introduction port 36A, and a connecting port 16A into which the pipe 54 can be inserted and which is communicated with the water jacket 15 is formed at a location corresponding to the pipe 54 as shown in FIG. 6. The exhaust passage 13 also opens at a location corresponding to the opening of the gas passage 35 in the joint part 16.

Thus, the gas passage 35 can be connected to the exhaust passage 13 and the water introduction port 36A and the water discharge port 36B of the water passage 36 can be connected to the water jacket 15 through the operation of securing the joint part 51 of the turbine housing 31 to the joint part 16 of the cylinder head 14 with the distal end of the pipe 54 inserted into the connecting port 16A of the cylinder head 14. This is a structure that enables the turbine housing 31, therefore the turbocharger 11, to be attached easily.

As shown in FIG. 6, the turbine housing 31 is attached to the cylinder head 14 with one metal seal member 55 and two rubber O-rings 56 and 57 interposed between the joint part 51 of the turbine housing 31 and the joint part 16 of the cylinder head 14. The seal member 55 is provided between the mating face 53 of the turbine housing 31 and the joint part 16 of the cylinder head 14 to prevent leakage of exhaust gas from the gas passage 35. The O-ring 56 is provided between the mating face 52 of the turbine housing 31 and the joint part 16 of the cylinder head 14 to prevent leakage of coolant from the water introduction port 36A of the water passage 36. The O-ring 57 is provided between the pipe 54 of the turbine housing 31 and the connecting port 16A of the cylinder head 14 to prevent leakage of coolant from the water discharge port 36B of the water passage 36.

In this embodiment, the mating face 52 of the turbine housing 31 and the outer periphery of a distal end portion (specifically, the part which is inserted into the connecting port 16A of the cylinder head 14) of the pipe 54 both function as a first mating face, and the O-rings 56 and 57 both function as a first seal member. In this embodiment, the mating face 53 of the turbine housing 31 functions as a second mating face, and the seal member 55 functions as a second seal member.

In addition, the joint part 51 of the turbine housing 31 has a third face normal to the mating faces 52 and 53 between the mating faces 52 and 53, and the mating faces 52 and 53 and the third face form a shape that is bent at two portions between an opening of the water passage 36 and an opening of the gas passage 35. The bent shape is a stepwise configuration with the mating face 52 protruding from the mating face 53. Further, the portions of the joint part 16 of the cylinder head 14 to which the mating faces 52 and 53 are connected also form generally the same stepwise configuration as the mating faces 52 and 53 and the third face do. Thus, the gap between the joint part 16 of the cylinder head 14 and the joint part 51 of the turbine housing 31 is bent in a stepwise fashion. Therefore, the flow of exhaust gas that leaks from the gas passage 35 onto the mating face 53 and travels toward the mating face 52 (the flow indicated by arrows A in FIG. 5 and FIG. 6) is less likely to reach the mating face 52 because it is blocked by the portion between the mating faces 52 and 53 (or the bent shape). Thus, the turbine housing 31 has a structure in which the exhaust gas that leaks from the gas passage 35 onto the mating face 53 is less likely to reach the mating face 52 compared to the case where the water passage and the gas passage open in the same face. This is a structure in which deterioration of the sealing performance of the water introduction port 36A of the water passage 36 that is caused by exposure of the O-ring 56 on the mating face 52 to high-temperature exhaust gas is less likely to occur.

In addition, in the turbine housing 31, the exhaust gas that leaks from the gas passage 35 onto the mating face 53 is blown onto the outer periphery of the pipe 54 as indicated by arrow B in FIG. 5 and FIG. 6 because the pipe 54 is located at a distance from the mating face 53 and extends in a direction normal to the mating face 53. Especially, the turbine housing 31 has a structure in which the exhaust gas that leaks onto the mating face 53 is less likely to be directed toward the gap between the pipe 54 and the connecting port 16A and is therefore unlikely to flow into the gap compared to the case where the direction in which the gap between the pipe 54 and the connecting port 16A extends form a dull angle with the direction in which the exhaust gas is blown onto the outer periphery of the pipe 54 because the exhaust gas is blown onto the outer periphery of the pipe 54 almost at a right angle. Thus, the turbine housing 31 has a structure in which the exhaust gas that leaks from the gas passage 35 onto the mating face 53 is less likely to flow into the gap between the pipe 54 and the connecting port 16A compared to the case where the water discharge port and the gas passage open in the same face. This is a structure in which deterioration of the sealing performance of the O-ring 57 in the gap between the pipe 54 and the connecting port 16A that is caused by exposure of the O-ring 57 to high-temperature exhaust gas is less likely to occur.

As described above, this embodiment provides the following advantages. (1) The gas passage 35 and the water introduction port 36A of the water passage 36 are arranged adjacent to each other in the joint part 51 of the turbine housing 31, and a third face is formed between the mating face 52, in which the water introduction port 36A opens, and the mating face 53, in which the gas passage 35 opens. The mating faces 52 and 53 and the third face form the above bent shape. Thus, the turbine housing 31 has a structure that enables it to be attached easily. In addition, this is a structure in which deterioration of the sealing performance of the water introduction port 36A of the water passage 36 that is caused by exposure of the O-ring 56 on the mating face 52 to high-temperature exhaust gas is less likely to occur.

(2) The joint part 51 of the turbine housing 31 is formed to have a stepwise configuration with the mating face 52, in which the water introduction port 36A opens, protruding relative to the mating face 53, in which the gas passage 35 opens. Thus, a portion having the above bent shape can be formed between the mating faces 52 and 53. Alternatively, the mating faces 52 and 53 and the face between the mating faces 52 and 53 can form the above bent shape.

(3) The gas passage 35 and the water discharge port 36B of the water passage 36 are arranged adjacent to each other in the joint part 51 of the turbine housing 31, and the pipe 54, which constitutes a part of the water discharge port 36B, protrudes in a direction across the mating face 53, in which the gas passage 35 opens. Thus, the turbine housing 31 has a structure that enables it to be attached easily. In addition, this is a structure in which deterioration of the sealing performance of the water discharge port 36B of the water passage 36 that is caused by exposure of the O-ring 57 in the gap between the pipe 54 and the connecting port 16A of the cylinder head 14 to high-temperature exhaust gas is less likely to occur.

(4) The mating face 53 of the turbine housing 31 is formed to have a planar shape and the pipe 54 extends in a direction normal to the mating face 53. This is a structure in which exhaust gas is less likely to flow into the gap between the pipe 54 and the connecting port 16A.

The above embodiment may be implemented with any of the following modifications. The mating face 52, in which the water introduction port 36A of the water passage 36 opens, and the mating face 53, in which the gas passage 35 opens, may be partially or entirely curved slightly.

The pipe 54 does not necessarily have to extend normal to the mating face 53 and may extend in any direction across the mating face 53. The joint part 51 of the turbine housing 31 may be formed in a stepwise configuration such that the mating face in which the gas passage 35 open protrudes relative to the mating face in which the water introduction port 36A open.

A structure in which a pipe extends in a direction across the mating face 53, in which the gas passage 35 open, and the pipe constitutes a part of the water introduction port 36A may be adopted instead of the structure in which the water introduction port 36A opens in the planar mating face 52. With this structure, the turbine housing is attached to the internal combustion engine with the end of the pipe inserted into the connecting port of the internal combustion engine and a rubber O-ring is provided between the outer periphery of a distal end portion of the pipe and the inner periphery of the connecting port of the internal combustion engine.

A structure in which the water discharge port 36B opens in a planar mating face of the turbine housing 31 may be adopted instead of the structure in which the pipe 54, which extends in a direction across the mating face 53, in which the gas passage 35 open, constitutes a part of the water discharge port 36B. With this configuration, the joint part of the turbine housing is formed in a stepwise configuration with one of the mating faces in which the pipe 54 and the water discharge port 36B open protruding relative to the other of the mating faces.

Only one of the water introduction port 36A and water discharge port 36B of the water passage 36 may be formed in the joint part 51 of the turbine housing 31.

The invention claimed is:

1. A turbine housing, comprising:

a water passage provided in the turbine housing, the water passage, through which coolant flows, being connected to a water jacket of an internal combustion engine, a gas passage provided in the turbine housing, the gas passage, through which exhaust gas flows, being connected to an exhaust passage of the internal combustion engine, the gas passage and the water passage both extend to open in the part that will be connected to the internal combustion engine, a joint part provided at a gas-introducing side of the turbine housing, the joint part having a first mating face in which the water passage opens and a single second mating face in which the gas passage opens, the water passage and the gas passage being arranged adjacent to each other in the joint part, and the second mating face not connecting smoothly to the first mating face, a first seal member interposed between the first mating face and the internal combustion engine to prevent coolant from leaking, and a second seal member interposed between the second mating face and the internal combustion engine to prevent exhaust gas from leaking, wherein the water passage and the gas passage are arranged in a side-by-side manner in the exhaust gas-introducing side joint part, and the water passage and the gas passage both open at the joint part, the first mating face, the second mating face, and a connection portion that connects the first mating face to the second mating face form a shape that is bent at one or more portions between an opening of the water passage and an opening of the gas passage, and the bent shape is a shape where one of the first mating face and the second mating face protrudes relative to the other of the first mating face and the second mating face, whereby a gap between the joint part of the turbine housing and a joint part of a cylinder head defines a predominantly stepwise shape, so as to block a flow of exhaust gas travelling toward the first mating face.

2. The turbine housing according to claim 1, wherein the joint part has a pipe that extends in a direction across the second mating face, the pipe constitutes a part of the water passage, and the first mating face is an outer periphery of a distal end portion of the pipe.

3. The turbine housing according to claim 2, wherein the second mating face is planar, and the pipe extends in a direction normal to the second mating face.

* * * * *